US011129421B2

(12) United States Patent
Gaber et al.

(10) Patent No.: US 11,129,421 B2
(45) Date of Patent: Sep. 28, 2021

(54) PROTECTIVE OUTER GARMENTS

(71) Applicant: Kiddazzle, Inc., Toronto (CA)

(72) Inventors: Stephanie Gaber, Thornhill (CA); Jared Gaber, Thornhill (CA)

(73) Assignee: Kiddazzle, Inc., Toronto (CA)

( * ) Notice: Subject to any disclaimer, the term of this patent is extended or adjusted under 35 U.S.C. 154(b) by 0 days.

(21) Appl. No.: 16/832,323

(22) Filed: Mar. 27, 2020

(65) Prior Publication Data

US 2020/0221792 A1 Jul. 16, 2020

Related U.S. Application Data

(60) Provisional application No. 62/824,944, filed on Mar. 27, 2019, provisional application No. 62/914,897, filed on Oct. 14, 2019.

(51) Int. Cl.
*A41B 13/10* (2006.01)
*A41D 11/00* (2006.01)

(52) U.S. Cl.
CPC ..... *A41B 13/10* (2013.01); *A41B 13/103* (2013.01); *A41D 11/00* (2013.01)

(58) Field of Classification Search
CPC ... A41B 13/10; A41B 13/103; A41B 2300/35; A41B 1/08; A41B 1/18; A41B 1/02; A41D 11/00; A41D 31/10; A41D 27/12; A41D 27/24; A41D 13/04; A41D 2300/50; A41G 11/002
USPC ..... 2/49.1, 49.2, 49.4
See application file for complete search history.

(56) References Cited

U.S. PATENT DOCUMENTS

| | | | | | |
|---|---|---|---|---|---|
| 996,084 | A | | 6/1911 | Herring | |
| 2,568,544 | A | | 7/1949 | Head | |
| 2,617,991 | A | * | 11/1952 | Killeen | A41D 11/00 2/75 |
| 3,608,092 | A | | 9/1971 | Taranto | |
| 4,772,503 | A | * | 9/1988 | Donsky | A41D 27/08 2/115 |

(Continued)

FOREIGN PATENT DOCUMENTS

| | | | | |
|---|---|---|---|---|
| GB | 2529487 A | * | 2/2016 | A41B 13/103 |
| GB | 2529487 A | | 2/2016 | |

OTHER PUBLICATIONS

International Search Report and Written Opinion of the International Searching Authority, PCT International application No. PCT/US2020/025263, dated Jun. 12, 2020.

*Primary Examiner* — Katherine M Moran
*Assistant Examiner* — Haley A Smith
(74) *Attorney, Agent, or Firm* — David A. Jones; Nadesan Beck P.C.

(57) ABSTRACT

Protective outer garments as well as improvements in the use and manufacture thereof. Protective outer garments disclosed herein can include an integrated, or connected, substantially resilient front protective portion and a moisture impervious barrier. The moisture impervious barrier can have sleeves and extend past the waistline of the child and at least over the wearer's shoulders to keep the front of the wearer's clothes clean and dry. The substantially resilient front protective portion can include a holder, like a traditional bib, for catching and holding food and liquids dropped or spilled by the wearer while eating, painting, making crafts, or other activity. The wearer can be a child, baby, elderly person, disabled or special needs person, for example.

19 Claims, 35 Drawing Sheets

(56) References Cited

U.S. PATENT DOCUMENTS

| | | | | |
|---|---|---|---|---|
| 5,153,940 | A | 10/1992 | Bergquist | |
| 5,652,962 | A | 8/1997 | Patnode | |
| 6,237,150 | B1 | 5/2001 | Lucas | |
| RE37,533 | E | 1/2002 | Beige et al. | |
| 6,442,759 | B1 | 9/2002 | Straham et al. | |
| D505,246 | S * | 5/2005 | Lennon | D2/860 |
| D505,247 | S * | 5/2005 | Lennon | D2/860 |
| 7,269,856 | B1 | 9/2007 | Cannan | |
| 7,269,858 | B2 | 9/2007 | Rothschild | |
| 7,409,726 | B2 | 8/2008 | Bahm et al. | |
| 7,409,729 | B2 | 8/2008 | Bahme et al. | |
| D608,529 | S * | 1/2010 | Wessler | D2/864 |
| 8,151,370 | B2 | 4/2012 | Perazzo | |
| D698,130 | S * | 1/2014 | Worden, IV | D2/864 |
| 9,226,529 | B2 * | 1/2016 | Monahon | A41B 13/103 |
| 9,289,015 | B2 * | 3/2016 | Kassis | A41B 13/106 |
| 9,392,821 | B1 * | 7/2016 | Baker | A41B 13/10 |
| 2004/0261152 | A1 * | 12/2004 | Mottl | A41B 13/103 2/50 |
| 2005/0028239 | A1 * | 2/2005 | Rees | A41B 13/10 2/49.1 |
| 2006/0000002 | A1 | 1/2006 | Bergkvist | |
| 2006/0010558 | A1 | 1/2006 | Prater | |
| 2007/0250978 | A1 | 11/2007 | Peterson | |
| 2008/0250541 | A1 | 10/2008 | Chen | |
| 2010/0122390 | A1 * | 5/2010 | Sender | A41B 13/08 2/49.2 |
| 2012/0174279 | A1 * | 7/2012 | Bailey | A41B 13/103 2/48 |
| 2015/0351462 | A1 * | 12/2015 | Thomas-Penny | A41B 13/103 2/49.2 |
| 2016/0037835 | A1 | 2/2016 | Mertz | |
| 2018/0168257 | A1 * | 6/2018 | Liu | A41D 27/24 |
| 2018/0199638 | A1 * | 7/2018 | Byrne | A41D 27/02 |
| 2018/0360131 | A1 * | 12/2018 | Wade | B32B 5/02 |
| 2019/0223518 | A1 * | 7/2019 | Schutte | A41D 13/04 |

* cited by examiner

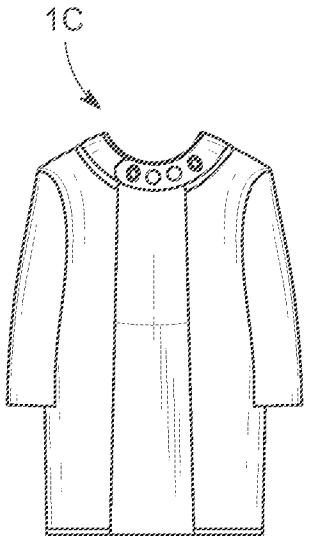
FIG. 2BBB

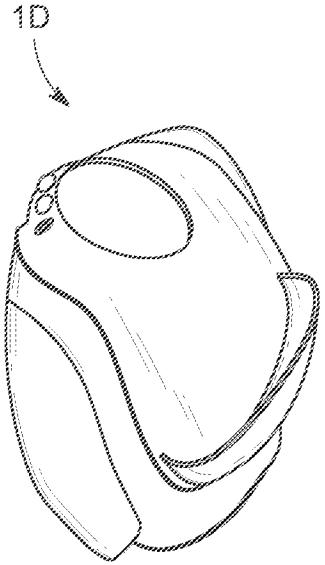
FIG. 2BBBB

PROTECTIVE OUTER GARMENTS

CROSS-REFERENCE TO RELATED APPLICATIONS

This patent application claims priority to and the benefit of U.S. Provisional Patent Application No. 62/824,944, filed Mar. 27, 2019, titled PROTECTIVE OUTER GARMENT. This patent application also claims priority to and the benefit of U.S. Provisional Patent Application No. 62/914,897, filed Oct. 14, 2019, titled PROTECTIVE OUTER GARMENT. Both of the aforementioned provisional patent applications are incorporated herein by reference in their entireties and for all purposes.

BACKGROUND

A smock is an outer garment traditionally worn by rural workers, especially shepherds and waggoners, in parts of England and Wales from throughout the 18th century. Today, the word smock refers to a loose overgarment worn to protect one's clothing, for instance by a painter.

A bib is a garment worn hanging from the neck on the chest to protect clothing from accidentally spilled food. Bibs are frequently used by young children, especially infants, but also by some adults. Bibs are also worn when consuming certain "messy" foods, such as lobster. In addition, bibs are used for infants when they drool a lot, for example when they are teething. The word "bib", reported in English since 1580, probably stems from the verb bibben "to drink" (c.1380), from the Latin bibere, either because it was worn while drinking or because it "soaked up" spills.

As parents of two toddlers, the named inventors of this patent application have spent countless hours struggling to remove food stains from their children's clothing. Each meal fed to their children inevitably led to a wardrobe change causing their laundry baskets to be constantly overflowing with dirty clothes. Their children became exceptionally talented at painting their clothing with hand-prints of spaghetti sauce and splotches of grape juice. The parents relentlessly tried to find a product that would adequately protect their children's clothing from the children's well-intended, but entirely unsuccessfully, attempts to feed food into their mouths without spilling on their clothes. Their house quickly become a museum of many different bibs in this pursuit. But, at the end of the day, these parents and inventors still had to explain to themselves, and to others, why their child's adorable and expensive little dress or shirt looked as though it had been passed down for generations. The inventors of this patent application were determined to find a way to minimize their time spent removing stains, and maximize fleeting moments they spend with their children.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

Embodiments disclosed herein are directed to protective outer garments. Such protective outer garments include a moisture impervious barrier for covering at least the shoulders and waistline of a wearer. The protective outer garments can include a substantially resilient front protective portion for covering at least the chest of the wearer. The substantially resilient front protective portion includes a holder shaped to catch and hold solids and liquids spilled upon the substantially resilient front protective portion while the wearer is eating, painting, making crafts, etc. The substantially resilient front protective portion can further include a collar, which can be adjustable. The collar can include one or more fastening features disposed at opposing ends of the collar for temporarily securing the collar around the neck of the wearer. The collar can also be made adjustable so as to accommodate different sized necks.

The moisture impervious barrier can further cover the arms of the wearer and upper legs of the wearer. According to various embodiments, the moisture impervious barrier can extend beyond the waistline or can be short sleeved. The moisture impervious barrier can include a hemline conforming to an outer periphery of the substantially resilient front protective portion. The hemline of the moisture impervious barrier can be sewn to the outer periphery of the substantially resilient front protective portion. The substantially resilient front protective portion can include a peripheral channel conforming to the shape of the hemline of the moisture impervious barrier. The moisture impervious barrier can be received within the peripheral channel of the substantially resilient front protective portion, the peripheral channel being sewn along with the hemline of the moisture impervious barrier disposed therein so as to securely fasten the hemline within the peripheral channel of the substantially resilient front protective portion.

The moisture impervious barrier can include a waistline. The waistline can be formed integral with an upper portion and/or a lower portion of the moisture impervious barrier; or the waistline can be merely decorative, visually apparent, and/or seamless relative to the upper and/or lower portion of the moisture impervious barrier.

A lower portion of the moisture impervious barrier can include a dress extending below the waistline according to a first example embodiment. The dress can include a front slit for accommodating a retaining strap of a chair. The lower portion can have the appearance of a tuxedo jacket according to a second example embodiment. The moisture impervious barrier can extend over the shoulders and around the back of the wearer. The substantially resilient front protective portion can be formed of molded silicone or another moisture impervious material such as rubber, plastic, etc. The substantially resilient front protective portion can have protrusions molded thereon. The substantially resilient front protective portion can be molded to simulate the shape and appearance of lapels and a tie according to the second example embodiment.

Methods of manufacturing and using a protective outer garment are disclosed. A method of molding a substantially resilient front protective portion for covering the chest of a wearer that includes a holder shaped to catch and hold solids and liquids spilled upon the substantially resilient front protective portion while the wearer is eating or performing other potentially messy activity such as painting or creating arts and crafts are disclosed. The method of manufacturing a protective outer garment can include affixing a moisture impervious barrier for covering at least the shoulders and waistline of the wearer to the substantially resilient front protective portion.

The method of manufacturing the protective outer garment can include defining and manufacturing a hemline of the moisture impervious barrier that corresponds in shape to an outer periphery of the substantially resilient front protective portion. The hemline of the moisture impervious barrier can be sewn to the outer periphery of the substantially resilient front protective portion.

The method of manufacturing the protective outer garment can include molding a peripheral channel at least partially around a periphery of the substantially resilient front protective portion, the hemline of the moisture impervious barrier being at least partially disposed within the peripheral channel of the substantially resilient front protective portion. The method can include the act of molding a substantially resilient front protective portion for covering at least the chest of the wearer. The method can further include molding the shape or appearance of a tie and lapel into a front side of the substantially resilient front protective portion. The act of molding a substantially resilient front protective portion for covering the chest of the wearer can further include molding the shape or appearance of simulated jewelry into a front of the substantially resilient front protective portion.

A protective outer garment is disclosed including a moisture impervious barrier for covering at least the shoulders and waistline of a wearer. The moisture impervious barrier can have the appearance of a dress or a tuxedo jacket. The moisture impervious barrier can include a hemline conforming to the shape of a substantially resilient front protective portion. The protective garment can include a substantially resilient front protective portion for covering at least the chest of the wearer, the substantially resilient front protective portion being molded from silicone.

The substantially resilient front protective portion can further include a holder shaped to catch and hold solids and liquids spilled upon the substantially resilient front protective portion while the wearer is eating, painting, creating crafts or performing other activities. In some embodiments, only a holder may be connected to the moisture impervious barrier. The substantially resilient front protective portion can include a collar. The can be adjustable and includes one or more fastening features disposed at opposing ends of the collar for temporarily securing the adjustable collar around the neck of the wearer. The substantially resilient front protective portion can include a peripheral channel having the hemline of the moisture impervious barrier disposed therein and stitching through the walls of the peripheral channel and through the hemline of the moisture impervious barrier, the stitching securing the moisture impervious barrier to the substantially resilient front protective portion. The substantially resilient front protective portion can include molded features simulating jewelry, a tuxedo with a tie and lapels, or other decorations. The substantially resilient front protective portion and/or the moisture impervious barrier can be substantially or entirely devoid of ornamentation.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION

Figure 1A:
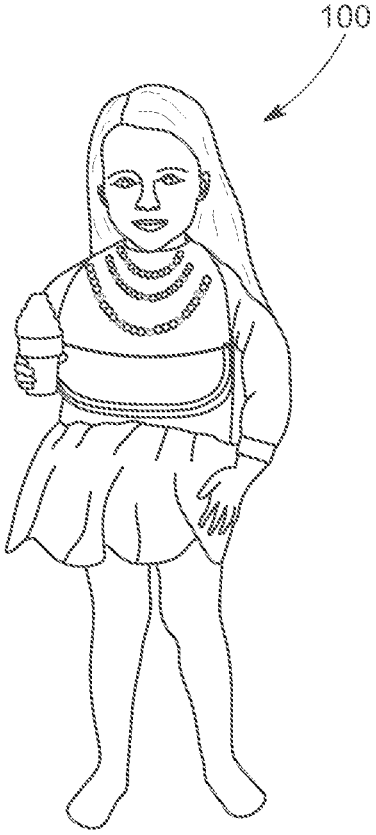
FIGS. 1A and 1AA illustrate a first example of an outer protective garment worn by a female child and a second example of an outer protective garment worn by a male child.
Figure 1A:
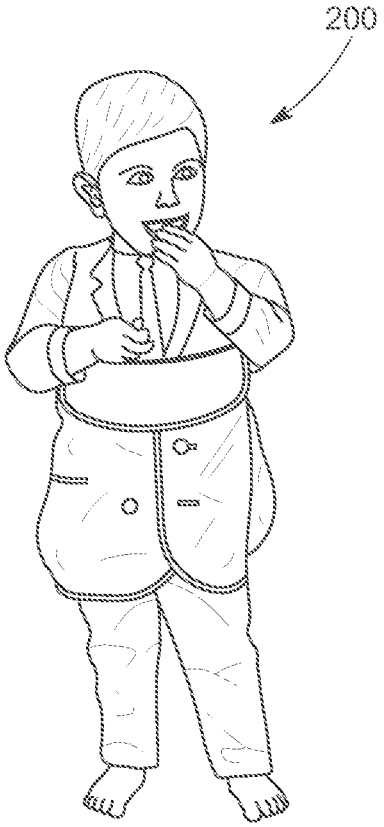

Embodiments of the invention disclosed herein relate to improvements in protective outer garments as well as improvements in the use and manufacture thereof. Protective outer garments disclosed herein can include an integrated, or connected, substantially resilient front protective portion and a moisture impervious barrier. The moisture impervious barrier can have sleeves and can extend past the waistline of the child and at least over the wearer's (e.g. a child's) shoulders to keep the front of the wearer's clothes clean and dry. The substantially resilient front protective portion can include a holder for catching and holding food and liquids dropped or spilled by the wearer while eating, painting, creating crafts and during other activities. The holder is substantially resilient and resistant to collapse as opposed to many traditional bibs and smocks, not made of silicone, which usually have a flat pocket often made of a single relatively flimsy material as opposed to a gutter style silicone holder pocket of the present invention.

After countless hours of research, development, revisions, kid-led testing and messy mealtimes, the inventors of this patent application developed the protective outer garments disclosed herein. Various preliminary designs and configurations leading up to such embodiments are further discuss herein and illustrate the various improvement of certain preferred embodiments. Such protective outer garments can include a functional, fun, and fashionable product that allows a child to have fun making a mess during mealtime without causing undue stress and laundry for the parents thereof.

As illustrated by the embodiment disclosed herein to illustrate examples of such embodiments, the design, shape, style, and function of the protective outer garment can be relatively easy to use, remove, clean, and reuse multiple times. According to some embodiments, the protective outer garment has an improved interconnection between the substantially resilient chest protective portion and the moisture impervious barrier so as to avoid food and liquids from accumulating or being caught within such interconnection. Such interconnection is an improvement over simple stitching of overlaid materials, for example. And, the interconnection can provide a protective outer garment having a plurality of different materials with different material properties and designs. The interconnection can include a channel formed, for example molded, in the periphery of the front protective portion. Such channel can receive, hold, and be connected to a hemline of the moisture impervious barrier such that the channel opening faces away from the neckline and collar of the front protective portion so as to allow food and liquids to fall and drain over the interconnection as opposed to be caught or accumulated therein.

The protective outer garment further provides components for combined aesthetic presentation of fun and exciting designs not previously possible, envisioned, or available. Similarly, the design of different moisture impervious barriers allows for a wearer, such as a child, infant, baby, or special needs wearer, to enjoy roll playing activities and fantasy scenarios while eating and playing.

The substantially resilient chest protective portion can be made of 100% food-grade silicone in some embodiments, which is non-toxic and hygienic as it is naturally resistant to bacteria. The moisture imperious barrier can be constructed using polyester with a waterproof coating, for example. The protective outer garment can be entirely BPA free, PVC free, lead free, and phthalate free according to some of the preferred embodiments. All of the materials can be easily wipeable, machine washable, waterproof, and stain and odor resistant according to various preferred embodiments. And, the preferred embodiments of the protective outer garment can be durable enough to withstand the most repeated and frequent use.

According to some embodiments, the protective outer garment can be sized to fit babies and toddlers ages six months and up. For example, various embodiments can include a size adjustable collar, or neck strap, with complementary fasteners disposed at opposing ends thereof that are easy to open and close, so such protective outer garments can be quickly secured onto a toddler even while such toddler is squirming. According to various embodiments, the resilient chest protective portion can include a molded silicone pocket that captures most food and liquids. The moisture impervious barrier can also include extra-long material to keep the laps of such wearer clean. The neck portion of the resilient chest protective portion and moisture impervious barrier can be designed to keep collars of underlying clothing fresh. The moisture impervious barrier may include long sleeves with cuffs that are snug enough to keep underlying sleeves of the clothes of the wearer dry, but stretchy enough to fit over relatively pudgy baby hands, according to certain example embodiments.

The protective outer garment can include a simplification of parts, ease of use and reuse, as well as improved utility including an integrated holder and a moisture impervious barrier among other advantages discussed herein. Such innovative designs can reduce the likelihood of food and liquids leaking onto the wearer's underclothing. Moreover, because the holder portion of the protective outer garment is integrated with, or connected to, the moisture impervious barrier, the protective outer garment can exhibit improvements in cleaning, comfortable wear, removal from the person wearing the garment, adjustability, and compact storage.

An outer protective garment according to various embodiments of the invention can include a moisture impervious barrier for covering at least the shoulders, neckline, chest and waistline of a wearer. The moisture impervious barrier can also extend over the shoulders and around the back of the wearer. The moisture impervious barrier can have short sleeves, long sleeves, or no sleeves. The protective outer garment can further include a substantially resilient front chest protective portion for covering the chest of the wearer. The substantially resilient chest protective portion can include a holder shaped to catch and hold solids and liquids spilled upon the substantially resilient chest protective portion. In some instance the substantially resilient chest protective portion can be shaped similar to a holder alone with the moisture impervious barrier integrated therewith.

The protective outer garment can further include an adjustable collar. The adjustable collar can be formed integral with the substantially resilient front chest protective portion. The moisture impervious barrier can include a hemline conforming to an outer periphery of the substantially resilient front protective portion and collar. The hemline of the moisture impervious barrier can be directly sewn to the outer periphery of the substantially resilient front protective portion in some advantageous embodiments where the resiliency and flexibility attributes of the substantially resilient chest protective portion, holder, and moisture impervious barrier differ. The hemline of the moisture impervious barrier can be bound to the outer periphery of the substantially resilient front protective portion.

According to some embodiments the moisture impervious barrier can be unornamented. According to some embodiments, the moisture impervious barrier can include a waistline. Attached to or integrated with the waistline can be a dress extending below the waistline. The dress can include an outer garment (as for a woman or girl) consisting of a one-piece bodice and skirt. The dress can include pleats, bellows, and/or folds, or can be straight in some embodiments. In another embodiment the moisture impervious barrier can resemble a suit, tuxedo or other apparel, costume such as a super hero, princess or character, occupation or sports uniform such as a police officer or baseball jersey, and other pretend wear such as holiday, historical or pop culture themes, or other fanciful design or decorative purpose in addition to utilitarian improvements enabled by the innovative designs disclosed herein.

Figure 1B:
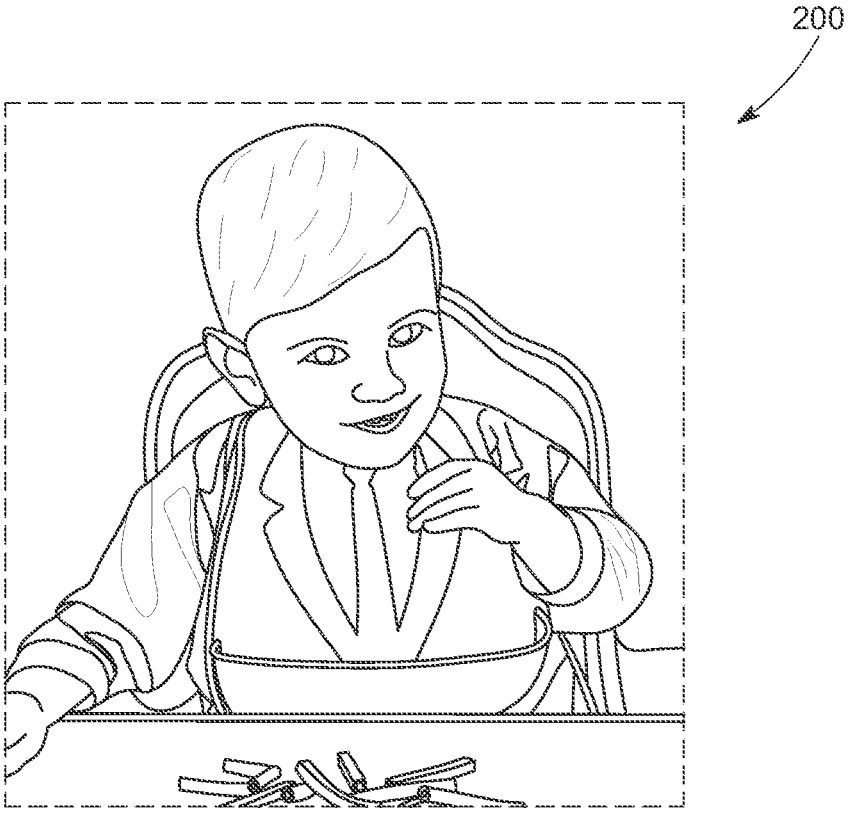
FIG. 1B illustrates the second embodiment of the outer protective garment worn by the boy while sitting and eating at a highchair.

Referring to FIGS. 1A and 1AA, a first example of a protective outer garment 100 and a second embodiment of a protective outer garment 200 are shown as worn by two children. Referring to FIG. 1B, the second embodiment of the protective outer garment 200 is shown while the child is enjoying his meal sitting at a high chair and simultaneously enjoying the fanciful experience provided by the tuxedo design of the second embodiment of the protective outer garment 200. As shown, other than potentially the lower portion of the child's pants, the children's underclothing is not exposed to the food being eaten by the child in this embodiment. However, according to some embodiments, the outer protective garment can extend entirely over the pants down to the wearer's ankles and optionally over the wearer's shoes when worn. Moreover, the protective outer garment 200 has an integrated holder 220 disposed below the child's mouth for catching and holding any food dropped by the child.

Figure 2A:
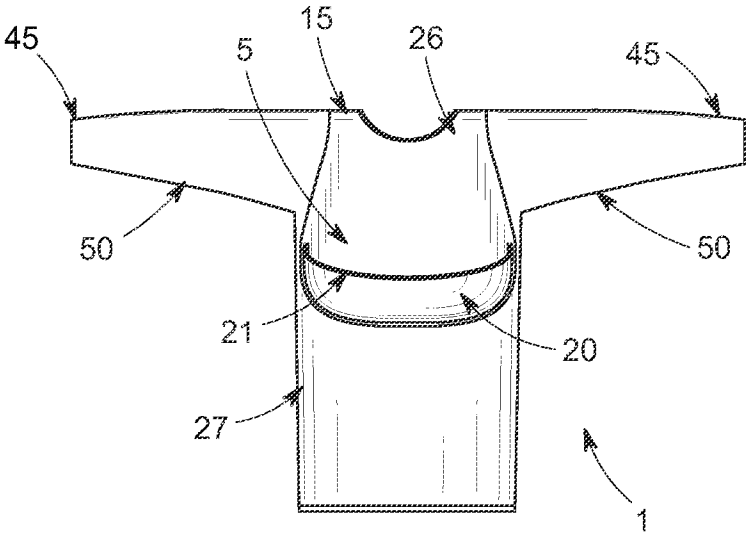
FIGS. 2A and 2AA illustrate components of a third example of the outer protective garment.
Figure 2A:
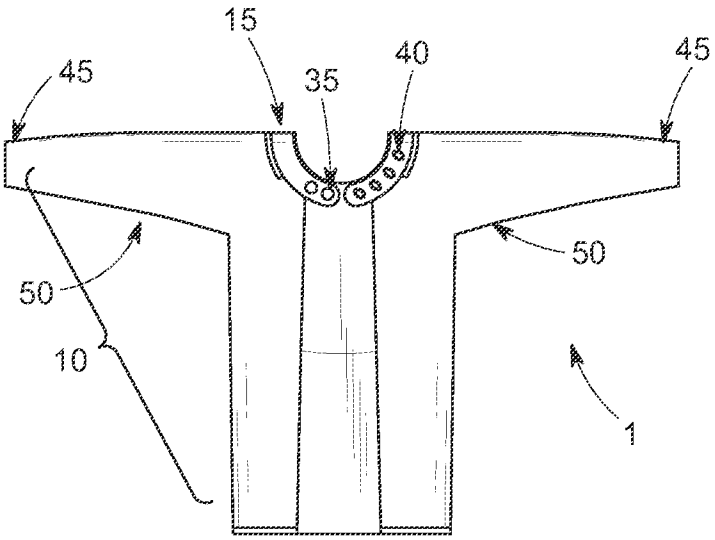

Referring to FIGS. 2A and 2AA, a third substantially unornamented protective outer garment 1 is shown according to an embodiment of the present invention. The protective outer garment 1 can include a substantially resilient chest protective portion 5 at least partially or entirely devoid of ornamentation or decorative design and a moisture impervious barrier portion 10 at least partially or entirely devoid of ornamentation or decorative design. The chest protective portion 5 can include a collar 15. The chest protective portion 5 can extend from, or hang from, the collar 15 to protect the chest of a wearer of the protective outer garment 1.

The construction of the chest protective portion 5 can have an elongated front body portion connected to, or preferably formed integral with, the collar 15. The collar 15 includes means for adjustably affixing the collar 15 around the neck of the wearer. Means for affixing an outer protective garment around the neck of a wearer as disclosed herein can include snaps or ties in place of, or in addition to, the buttons 35 extending from the collar 15 and corresponding holes 40 in the collar or upper periphery of the substantially resilient chest protective portion 5. The adjustable connection means can also be directly attached to the moisture impervious barrier 10 or connected and adjustable in any manner.

A horizontally disposed forwardly projecting holder 20 is connected to, or preferably formed integral with, the chest protective portion 5. According to other embodiments, the holder 20 alone can be connected to, the moisture impervious barrier 10, such as sewn, melded, molded, or formed integral therewith, without extending over the chest of the wearer. The holder 20 can have a stiff upper edge 21, which can be reinforced by being molded to have an increased thickness so as to avoid collapsing. The holder 20 can be sized and configured to have an appropriate continuous radius and sized so as to easily and completely scoop and remove contents therefrom. The holder 20 can also be made of a substantially resilient and flexible yet supportive material so as to resist collapsing during use. The moisture impervious barrier 10 can be substantially more flexible than the chest protective portion 5 and holder 20 so as to be worn comfortably over the underclothing of a child or other wearer.

The chest protective portion 5 can be formed from a durable, moisture-proof and washable material such as a suitable synthetic resin or silicone. The free edges of the chest protective portion 5 and collar portions 15 may have edges either stitched into position, integrated by heat-sealing means, or otherwise integrally connected to inner seams or edges of the moisture impervious barrier 10. The moisture impervious barrier can have short sleeves, puffy sleeves, decorative sleeves, or even a minimum width or no sleeves such as a tank top, sleeveless shirt, or other design.

Figure 9:
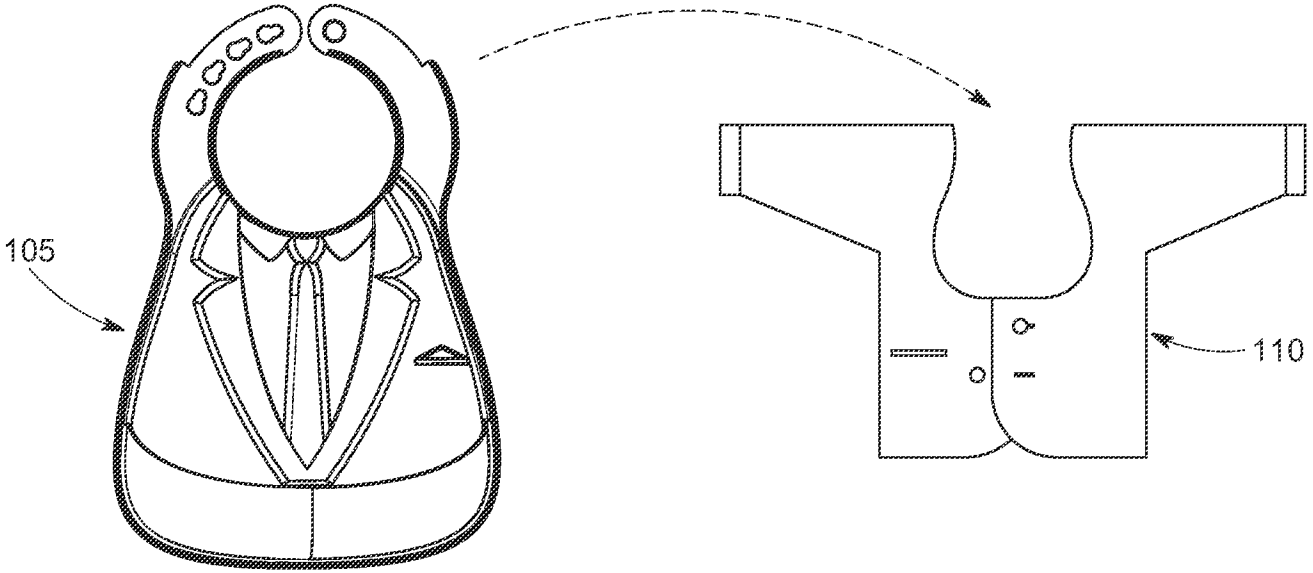
FIG. 9 illustrates methods of assembly and manufacture of the second embodiment of the outer protective barrier.

The shape of the inner seams, or a continuous hemline, of the moisture impervious barrier 10 can conform in shape to the outer periphery of the chest protective portion 5 (e.g. see FIGS. 9, 12A, and 12B) and may also be sewn, melded, molded, or formed integral therewith. In some embodiments, the chest protection and/or the holder can be sewn over a top of a chest portion of the shirt portion 30 of the moisture impervious barrier 10. According to certain preferred embodiments, the periphery of the chest protective portion 5 can include a radially extending channel for receiving a hemline of the moisture impervious barrier 10 therein (e.g. see FIGS. 11A and 11B). The hemline of the moisture impervious barrier can be secured within the channel of the chest protective portion. The chest protective portion 5 can also be sewn over the moisture impervious barrier 10 in some embodiments. The sidewalls of the channel extending around a periphery of the substantially resilient chest protective portion can extend away from the neckline and mouth of the wearer when worn so as to avoid accumulation of food or liquids within the interconnection between the moisture impervious barrier 10 and the substantially resilient chest protective portion 5.

Figure 2B:
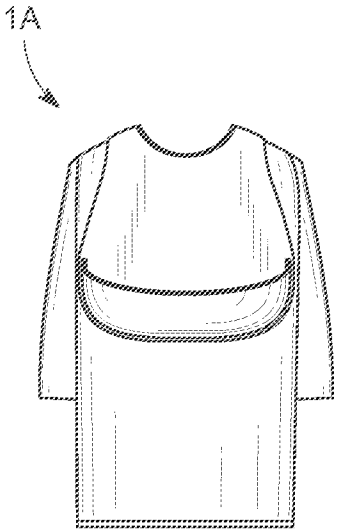
FIGS. 2B, 2BB, 2BBB, and 2BBBB show various views of the third example of the outer protective barrier.
Figure 2B:
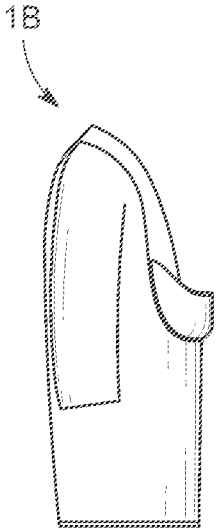

Referring to FIGS. 2B, 2BB, 2BBB, and 2BBBB, a front view 1A, left side view 1B, rear view 1C, and a left-front perspective view 1D of the protective outer garment 1 are shown. Referring again to FIGS. 2A and 2AA, the front of the protective outer garment 1 is shown in FIG. 2A and includes the chest protective portion 5 and the moisture impervious barrier portion 10. The chest protective portion 5 and holder portion 20 can be injection molded silicone, compression molded silicone, or other material. The chest protective portion 10 can include the collar 15 which extends around a front side and a rear side (also see FIGS. 2B, 2BB, 2BBB, and 2BBBB) of the wearer when wearing the protective outer garment 1. Located at the bottom of the chest protective portion 5, the holder 20 is an outwardly projecting pocket for catching and holding food, liquids, paint, and other solids and liquids that would otherwise be spilled onto the underclothing of the wearer of the protective outer garment 1.

Referring to the front of the chest protective portion 5 of the third embodiment of an outer protective garment 1, a substantially flat surface of the chest protective portion 5 covering the wearer's chest is unornamented and devoid of a decorative design element. The holder 120 can be in the form of an outer projecting pocket can include a lip extending around an upper inner gutter of the pocket to further add rigidity to the pocket.

Referring to FIG. 2AA, the rear of the protective outer garment 1 is shown. The collar 15 may partially or fully extend around a neckline of an upper shirt portion 30 of the moisture impervious barrier 10. The collar 15 includes one or more protrusions 35 corresponding with one or more interlocking holes 40 for adjustably connecting the rear ends of the collar 15 together when worn. The one or more protrusions 35 can be in the form of a button on a post and is sized to fit into the holes 40 within the opposing end of the collar 15. The collar 15 is adjoined to the neckline of the upper shirt portion 30 of the moisture impervious barrier 10 by stitching, melding, adhesive, or other direct connecting means. The moisture impervious barrier 10 can be at least partially or entirely devoid of ornamentation according to this embodiment.

According to certain embodiments the moisture impervious barrier can be made from polyester, nylon coated with polyurethane, synthetic rubber, vinyl, etc. or a combination thereof such as a polyester having a polyurethane coating, for example. The outer periphery of the chest protective portion 5 can correspond with the shape of the front hemline of the shirt portion 30 of the moisture impervious barrier 10 and sewn and/or bonded thereto. Thus, the chest protective portion 5 does not overlay the moisture impervious barrier 10. Rather, the chest protective portion 5 and the moisture impervious barrier 10 become an integrated protective outer garment 1 without requiring independent cleaning thereof and saving dual layers of ineffective protective layers and unsealed seams there between.

Figure 3A:
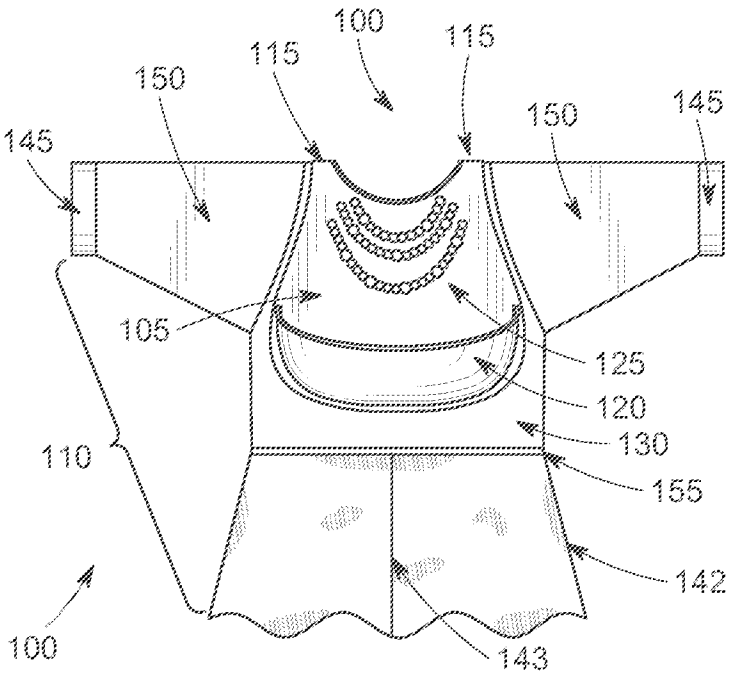
FIGS. 3A and 3B illustrate components of the first example of the outer protective garment.

Referring to FIGS. 3A and 3AA, the first protective outer garment 100 is shown according to an embodiment of the present invention. The protective outer garment 100 can include a substantially resilient chest protective portion 105 and a moisture impervious barrier portion 110. The chest protective portion 105 can include a collar 115. The chest protective portion 105 can extend from, or hang from, the collar 115 to protect the chest of a wearer of the protective outer garment 100.

The construction of the chest protective portion 105 can have an elongated front body portion connected to, or preferably formed integral with, the collar 115. The collar 115 includes and means for adjustably affixing the collar 115 around the neck of the wearer. A horizontally disposed forwardly projecting holder 120 is connected to, or preferably formed integral with, the chest protective portion 105. The holder 120 can have a stiff upper edge, which can be reinforced by being molded to have an increased thickness so as to avoid collapsing. The holder 120 can be sized and configured to have an appropriate continuous radius and sized so as to easily and completely scoop and remove contents therefrom. The holder 120 can also be made of a substantially resilient and flexible yet supportive material so as to resist collapsing during use. The moisture impervious barrier 110 can be substantially more flexible than the chest protective portion 105 and holder 120 so as to be worn comfortably over the underclothing of a child or other wearer.

The chest protective portion 105 can be formed from a durable, moisture-proof and washable material such as a suitable synthetic resin or silicone. The free edges of the chest protective portion 105 and collar portions 115 may have edges either stitched into position, integrated by heat-sealing means, or otherwise integrally connected to inner seams or edges of the moisture impervious barrier 110. The shape of the inner seams, or a continuous hemline, of the moisture impervious barrier 110 can conform in shape to the outer periphery of the chest protective portion 105 (e.g. see FIGS. 9 and 12A) and may also be sewn, melded, molded, or formed integral therewith. In some embodiments, the chest protection and/or the holder can be sewn over a top of a chest portion of the shirt portion 130 of the moisture impervious barrier 110. According to certain preferred embodiments, the periphery of the chest protective portion 105 can include a radially extending channel for receiving a hemline of the moisture impervious barrier 110 therein (e.g. see FIGS. 11A and 11B). The hemline of the moisture impervious barrier can be secured within the channel of the chest protective portion. The sidewalls of the channel extending around a periphery of the substantially resilient chest protective portion can extend away from the neckline and mouth of the wearer when worn so as to avoid accumulation of food or liquids within the interconnection between the moisture impervious barrier 110 and the substantially resilient chest protective portion 105.

Figure 4A:
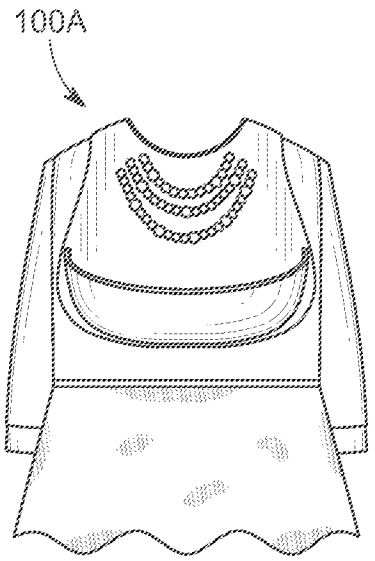
FIGS. 4A, 4B, 4C, and 4D show various views of the first example of the outer protective garment.
Figure 4B:
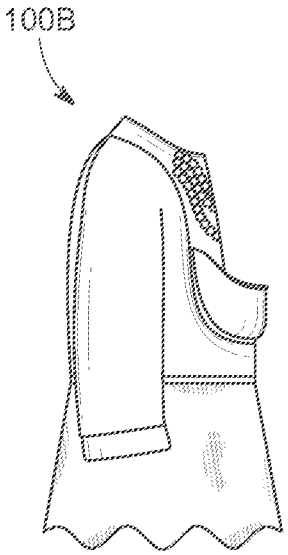
Figure 4C:
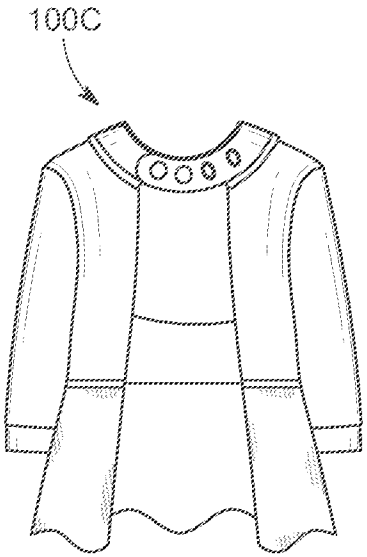
Figure 4D:
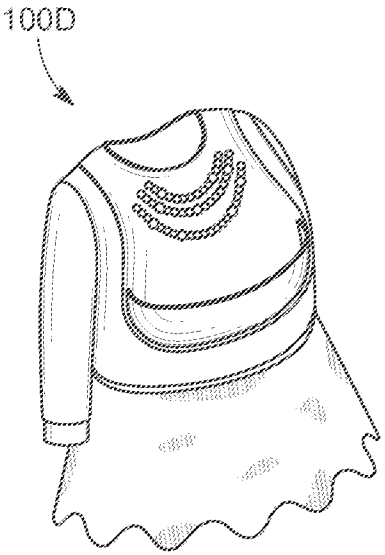

Referring to FIGS. 4A, 4AA, 4AAA, and 4AAAA, a front view 100A, left side view 100B, rear view 100C, and a left-front perspective view 100D, respectively, of the protective outer garment 100 are shown according to the dress embodiment example of the invention. Referring again to FIG. 3A, the front of the protective outer garment 100 is shown and includes the chest protective portion 105 and the moisture impervious barrier portion 110. The chest protective portion 105 and holder portion 120 can be injection molded silicone, compression molded silicone, or other material. The chest protective portion 110 can include the collar 115 which extends around a front side and a rear side (also see FIG. 4) of the wearer when wearing the protective outer garment 100. Located at the bottom of the chest protective portion 105, the holder 120 is an outwardly projecting pocket for catching and holding food, liquids, paint, and other solids and liquids that would otherwise be spilled onto the underclothing of the wearer of the protective outer garment 100.

Referring to the front of the chest protective portion 105 of the first embodiment 100, an otherwise substantially flat surface of the chest protective portion 105 covering the wearer's chest can include a decorative design element 125. The decorative design element 125 can be injection molded or compression molded therewith. The injection or compression molded decorative design element 125 may be formed when the chest protective portion 105 and holder 120 are made by injection molding process, compression molding process, or other manufacturing process. The decorative design element 125 can also be applied to the protective portion 105 in another manner. The decorative design element 125, in this instance a neckless, can have color, paint, stones, glitter, or other decorations applied thereto while or after the chest protective portion 105 is molded. Because the chest protective portion 105 is made from a water-tight and substantially non-porous material the holder 120 can be easily and repeatably cleaned after use while protecting the garments worn beneath. The holder 120 can be in the form of an outer projecting pocket can include a lip extending around an upper inner gutter of the pocket to further add rigidity to the pocket.

Figure 3B:
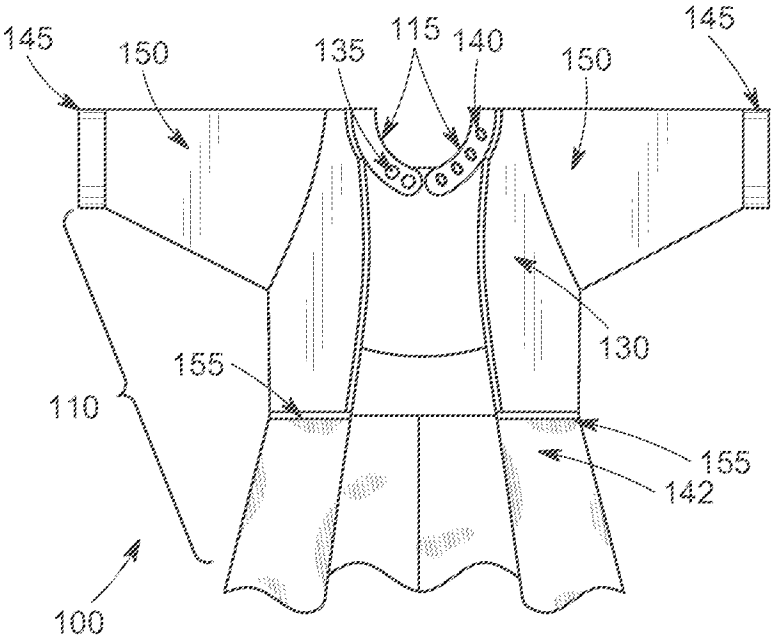

Referring to FIG. 3B, the rear of the protective outer garment 100 is shown. The collar 115 may partially or fully extend around a neckline of an upper shirt portion 130 of the moisture impervious barrier 110. The collar 115 includes one or more protrusions 135 corresponding with one or more interlocking holes and slots 140 for adjustably connecting the rear ends of the collar 115 together when worn. The one or more protrusions 135 can be in the form of a button on a post and is sized to fit into the holes 140 and slide, or fit, into an interlocking slot within the opposing end of the collar 115 in some embodiments in other embodiments the key hole slot may be omitted using just a collar button and collar hole attachment features so as to secure the collar 115 around the neckline of the wearer of the protective outer garment 100. As previously mentioned, the collar 115 is adjoined to the neckline of the upper shirt portion 130 of the moisture impervious barrier 110 by stitching, melding, adhesive, or other direct connecting means.

The moisture impervious barrier 110 can be described as having an upper shirt portion 130 and a lower dress portion 142. The lower dress portion 142 may include a slit 143 in some embodiments. The slit 143 can be disposed at or near the middle of the front of the lower dress portion 142 (in this example) so as to allow for the lower dress portion 142 to accommodate a strap or other retaining/restraining device of a high chair, for example.

The shirt portion 130 can include cuffs 145 disposed at the ends of sleeves 150 as shown in FIGS. 3A and 3B. The bottom of the shirt portion 130 can include a waistline 155 which divides the shirt portion 130 from the dress portion 142. The waistline 155 may be ornamental as change in color where the shirt portion 130 is made from an integral or unitary material along with the dress portion 142. Or, the waistline 155 may be an independent material sewn between the upper shirt portion 130 and the lower dress portion 142. Similarly, the waistline may be made integral with, or separate to, the upper shirt portion 130 and/or the lower dress portion 142. In this embodiment, the bottom of the dress portion 142 can be defined as a bottom hemline. When viewed from the rear, the bottom hemline can abruptly, or gradually (not shown), extend up toward the waistline 155 and into the shirt portion 130.

The upper shirt portion 130 of the moisture impervious barrier 110, can have a front cutout that conforms to the outer shape of the chest protective portion 105. As previously discussed, according to some embodiments, the chest portion 105 and/or holder 120 can be sewn onto the upper shirt portion 130 of the moisture impervious barrier 110 as opposed to having a cutout to the upper shirt portion 130 shaped and sewn to an outer end of the chest protective portion 105 and/or holder 120. The chest protective portion 105 and holder 120 can be molded together from molded silicone, for example. And, the front of the shirt portion 130 of the moisture impervious barrier 110 can be made of a silicone press fabric in some embodiments.

According to certain embodiments the moisture impervious barrier can be made from polyester, nylon coated with polyurethane, synthetic rubber, vinyl, etc. or a combination thereof such as a polyester having a polyurethane coating, for example. The outer periphery of the chest protective portion 105 can correspond with the shape of the front hemline of the shirt portion 130 of the moisture impervious barrier 110 and sewn and/or bonded thereto. Thus, the chest protective portion 105 does not overlay the moisture impervious barrier 110. Rather, the chest protective portion 105 and the moisture impervious barrier 110 become an integrated protective outer garment 100 without requiring independent cleaning thereof and saving dual layers of ineffective protective layers and unsealed seams there between.

As shown in FIGS. 3A and 3B, the lower portion of the protective outer garment 100 below the waistline 155 can be a dress 140 and can be loose and decorative such as to appear similar to a formal or fanciful dress in this example. The dress 142, color of the shirt 130, and decorative design element 125 in the form of imitation jewelry of the protective outer garment 100 can be fun and exciting to wear while a child, infant, elderly, special needs person, or baby is eating or performing another activity. When the child is finished eating, the singular protective outer garment 100 can be removed and cleaned as opposed to multiple protective components or layers without food-tight and water-tight seams there between. Moreover, the portions of the garment 100 may be made as seamless as possible so as to avoid food and liquid from being caught within such seams. For example, the waistline may be made integral with the upper shirt portion 130 and lower dress portion 142 in some examples so as to avoid seams there between. In such embodiments, the waistline 155 and cuffs 145 can be decorative as a change in color only, as opposed to a seam in fabric or material. As such, the protective outer garment 100 illustrated in FIG. 3 exhibits many improvements over the protective outer garments previously available.

Figure 5A:
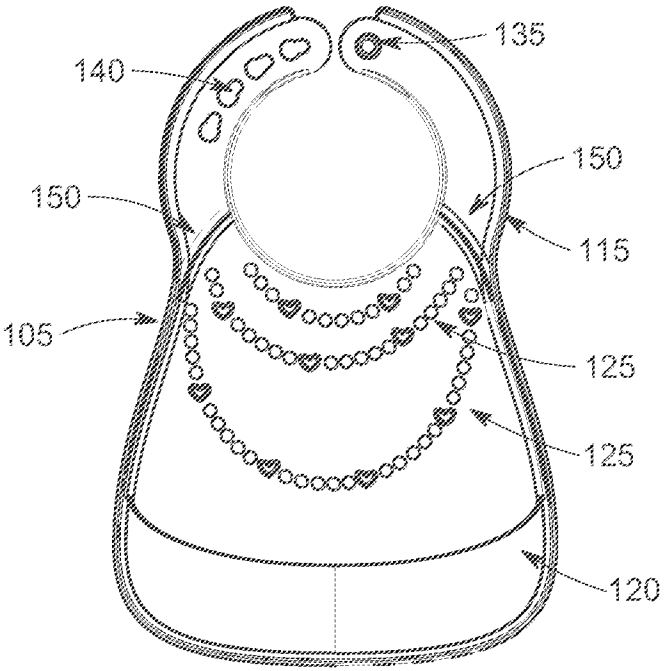
FIGS. 5A, 5AA, 5B, and 5BB show various views of the front protective portion, holder, collar, and decorative components of the first embodiment of the outer protective garment.
Figure 5A:
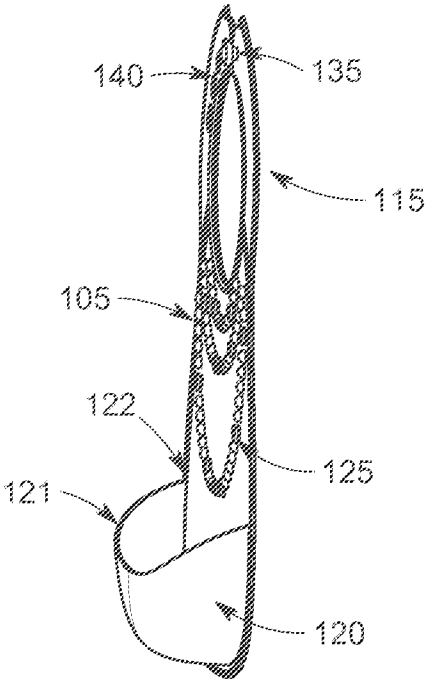
Figure 5B:
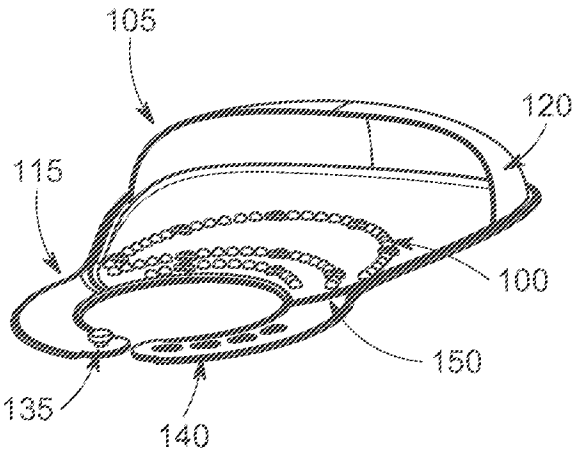
Figure 5B:
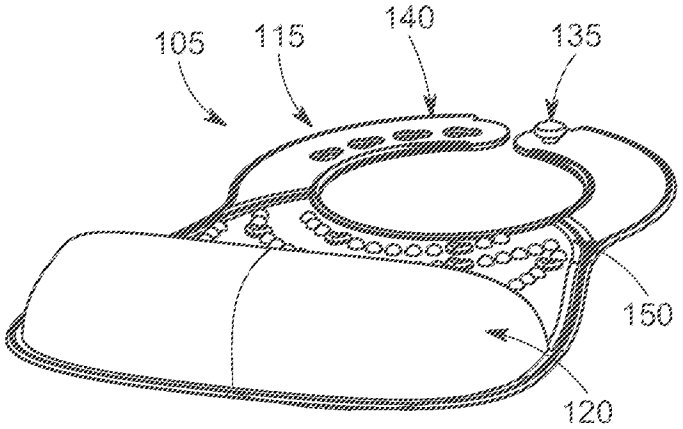

Referring to FIGS. 5A, 5AA, 5B and 5BB, the chest protective portion 105 of FIGS. 3A, 3B, 4A, 4B, 4C, and 4D is shown separate from the moisture impervious barrier portion 110. FIGS. 5A and 5B show the chest protective portion 105 from a front and side view, respectively, including the adjustable collar 115 and the outwardly projecting pocket 120. The chest protective portion 105 has an outer periphery corresponding to a front hemline of a moisture impervious barrier and collar 115 corresponding to a rear hem line of a moisture impervious barrier (e.g. see FIGS. 3A and 3B). This outer periphery of the chest protective portion 105 and collar 115 can be sewn to the corresponding shaped hem line of the moisture impervious barrier. The connection between the outer periphery of the chest protective portion 105 and the front and rear hemline of a moisture impervious barrier can be substantially water-tight such that water and food spilled over the connection between the chest protective portion 105 and the moisture impervious barrier portion 110 is impervious to leakage there through. Rather, such spills are easily cleaned simultaneously from the chest protective portion 105 and the moisture impervious barrier portion. The chest protective portion 105 can include molded seams or areas of a reduced thickness 150 or other characteristic for bending the collar of the holder around the neck of a child or other person wearing the protective outer garment 100. As previously discussed a decorative design element 125 in the form of a simulated neckless is molded or applied to the chest protective portion 105.

The chest protective portion 105 can include a lip disposed around a rim 121 of the holder 120 that can correspond in location to a bar 122 of added thickness disposed on, or molded with, the holder 120 of the chest protective portion 105 that lends additional thickness and rigidity thereto so as to prevent, or reduce, a likelihood of the holder 120 collapsing.

Figure 6A:
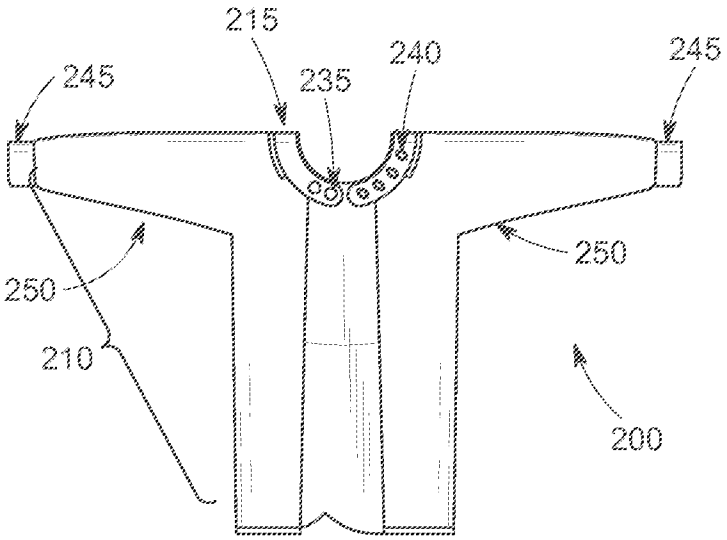
FIGS. 6A and 6B illustrate components of the second example embodiment of the outer protective garment.
Figure 6B:
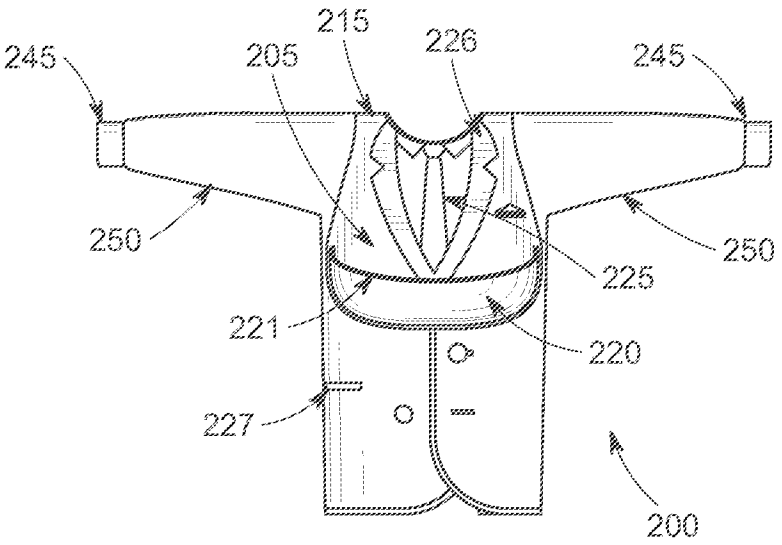
Figure 7A:
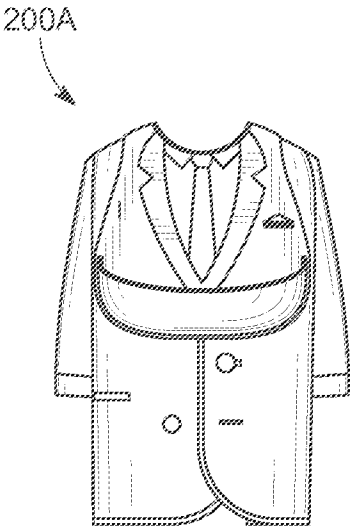
FIGS. 7A, 7B, 7C, and 7D show various views of the second example of the outer protective garment.
Figure 7B:
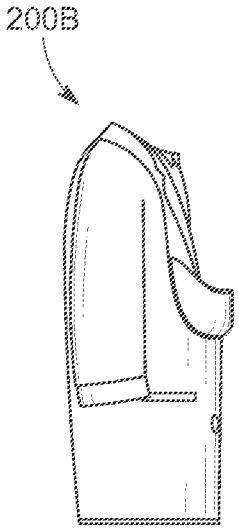
Figure 7C:
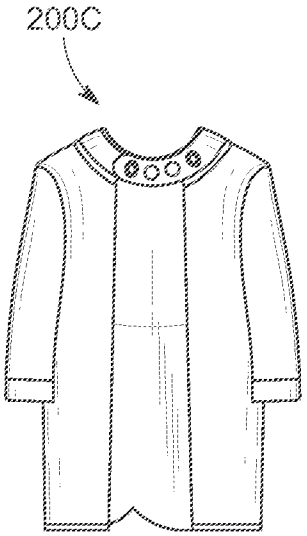
Figure 7D:
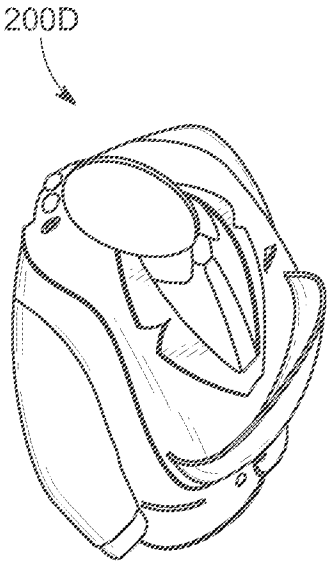

FIGS. 6A AND 6B illustrate the second example embodiment of the protective outer garment 200. The protective outer garment 200 is in the form of a suit or tuxedo design. The protective outer garment 200 also includes a combined chest protective portion 205 and moisture impervious barrier portion 210. The chest protective portion 205 has an outer periphery sewn, melded, or bound to the chest hemline of the moisture impervious barrier portion 210. In this example, the moisture impervious barrier 210 appears as a shirt, tie, and suit jacket including the front, rear, neckline, lapels 226, a pocket 227, buttons, sleeves 250 and cuffs 245.

In this example, the chest protective portion 205 is molded and/or colored to appear like a suit or tuxedo with shirt and tie. Referring to the front of the chest protective portion 205 shown in FIG. 6B, an otherwise substantially flat surface can include a decorative design 225 injection molded or compression molded thereon. The injection molded or compression molded decorative design 225 may be formed when the chest protective portion 205 itself is made by injection molding, compression molding or other manufacturing process. The decorative design 225 can also be applied to the holder 220. The decorative design 225, in this instance the dark tie, shirt collar and lapel 226, can be applied thereto after the chest protective portion 205 is molded or simultaneous with molding of the rest of the chest protective portion 205. Because the chest protective portion 205 is made from a water-tight and substantially non-porous material the chest protective portion 205 is easily cleaned after use. The outwardly projecting holder 220 can include a lip 221 extending around an inner gutter of a pocket of the holder 220 to further add rigidity to the pocket. The lip 221 can also extend around the chest protective portion 105 as a peripheral lip or support bar corresponding to the upper lip or edge of the holder 120 so as to lend rigidity and help prevent the collapse of the holder 120.

The collar 215 of the chest protective portion 205 extends partially or fully around a neckline of the moisture impervious barrier 210 as shown in FIG. 6A. Similar to the previous first example, the collar 215 of the second example of a protective outer garment 200 can include one or more protrusions 235 corresponding with a series of holes and slots 240 for adjustably connecting the rear ends of the collar 215 together when worn. The protrusion 235 is sized to fit into the holes 240 so as to be adjustable depending on the holes 240 inserted. The protrusions 225 can have a post and button that slides into an interlocking slots and holes 240 within the opposing end of the collar 215 so as to secure the collar 215 around the neckline of the person wearing the protective outer garment 200. As previously mentioned, in some embodiments, the slots are omitted and only a button and retaining hole may be used. As previously mentioned, the collar 215 can be adjoined to the neckline of the moisture impervious barrier 210 by stitching, melding, adhesive, or other direct connecting means or may be formed integral therewith. In other embodiments, the silicone neck straps may be removed such that the retaining features are implemented on the moisture impervious barrier portion 210 as opposed to being part of the collar 215.

The moisture impervious barrier portion 210, can have a front cutout that conforms to the outer shape of the chest protective portion 205. The chest protective portion 205 can be made from a compression molded silicone or injection molded silicone, for example. And, the front of the moisture impervious barrier 210 can be made of a silicon press fabric in some embodiments. Other materials for the chest protective portion 205 and moisture impervious barrier portion 210 may be used generally so long as the material resists absorption of liquids and may be easily cleaned. The outer periphery of the chest protective portion 205 can correspond with the shape of the front of the moisture impervious barrier 210 and sewn and/or bonded thereto. Thus, the chest protective portion 205 does not overlay the moisture impervious barrier 210 according to preferred embodiments. Rather, the chest protective portion 205 and the moisture impervious barrier portion 210 become an integrated protective outer garment 200 without requiring independent cleaning thereof and saving dual layers of ineffective protective layers, unsealed seams there between, and potentially unwanted food from finding its way in between individual clothing parts. FIGS. 7A, 7B, 7C, and 7D show the second embodiment of the protective outer garment from a front view 200A, left side view 200B, rear view 200C and front-left perspective view 200D, respectively.

Figure 8A:
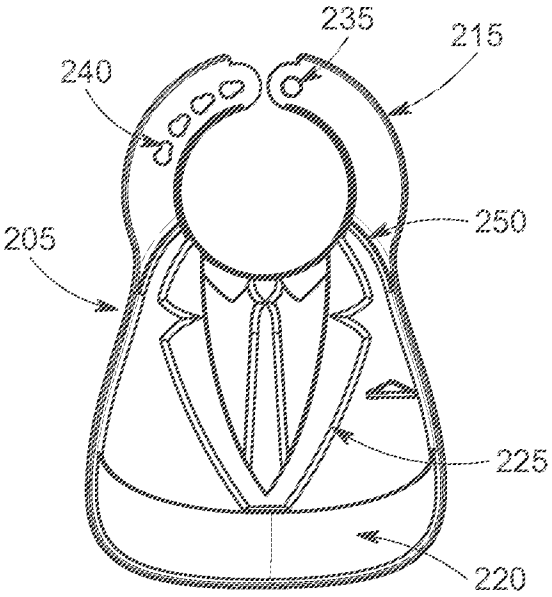
FIGS. 8A, 8AA, 8B, and 8BB show various views of the front protective portion, holder, collar, and decorative components of the second embodiment of the outer protective garment.
Figure 8A:
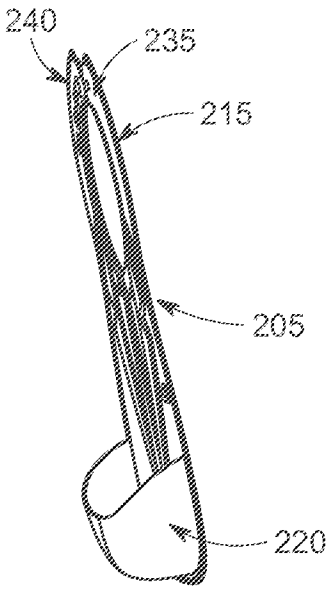
Figure 8B:
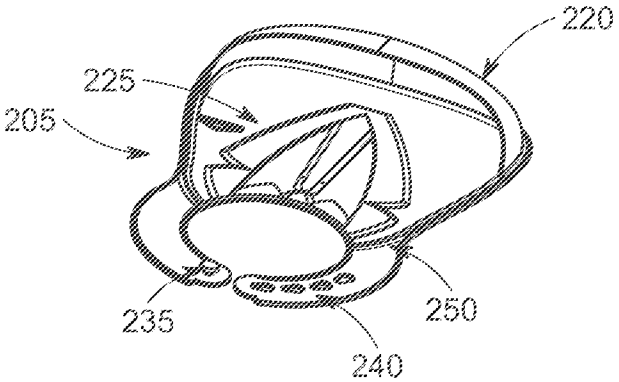
Figure 8B:
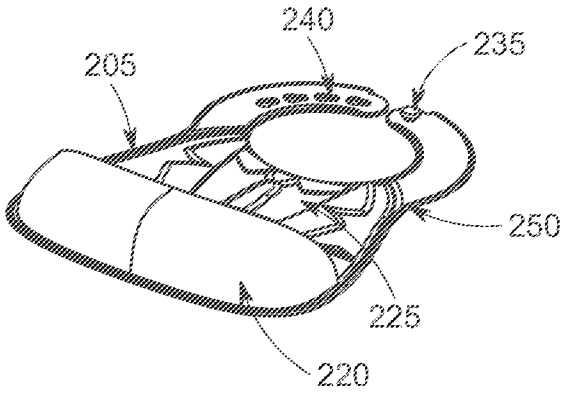

FIGS. 8A, 8AA, 8B, and 8BB illustrate where the chest protective portion 205 can be formed from a durable, moisture-proof, washable material such as a suitable synthetic resin or silicone. The free edges of the chest protective portion 205 and collar portions 215 may have edges either stitched into position, integrated by heat-sealing means, or otherwise integrally connected to inner seams of the moisture impervious barrier 210 as shown in FIGS. 8A, 8AA, 8B, and 8BB. The shape of the inner seams of the moisture impervious barrier 210 can conform in shape to the outer periphery of the chest protective portion 205 and can or may also be sewn, melded, molded, or formed integral therewith as shown in FIGS. 9, 10, 11A, 11B, 12A, and 12B.

Figure 10:
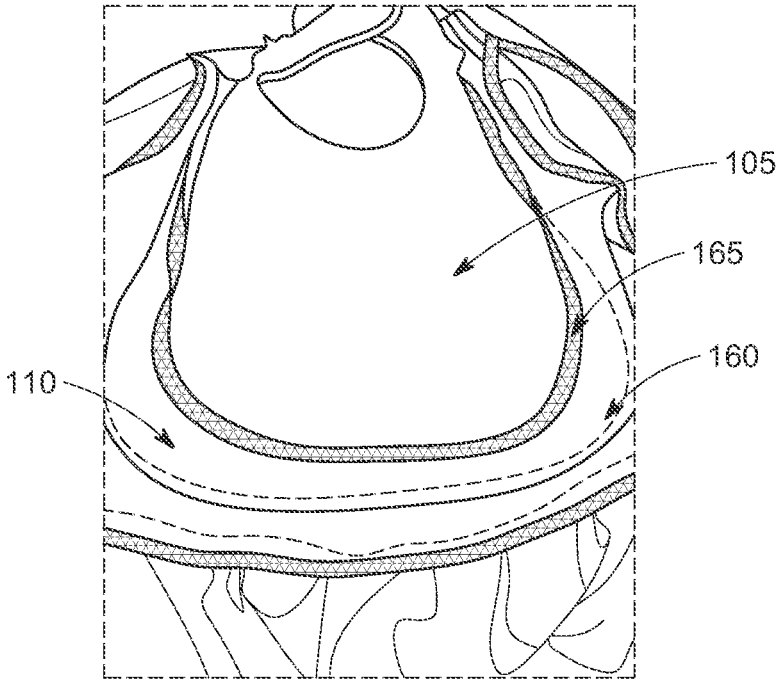
FIG. 10 illustrates methods of assembly and manufacture of the first embodiment of the outer protective barrier.

In some embodiments, the chest protection and/or the holder can be sewn over a top portion of the shirt portion of the moisture impervious barrier 110 as shown in FIG. 10. However, as shown in FIG. 10, when the chest protective portion 105 is sewn 160 over the front of the moisture impervious barrier 110 there is a seam 165 created where the underside of the chest protective portion 105 overlays the moisture impervious barrier 110 of the protective outer garment 100. This underside seam 165 is prone to catch food that may fall underneath the protective outer garment 100 from between the collar 115 and the neck of the child or infant wearing the protective outer garment 100 or debris that may accumulate therein during cleaning of the protective outer garment 100.

Figure 11A:
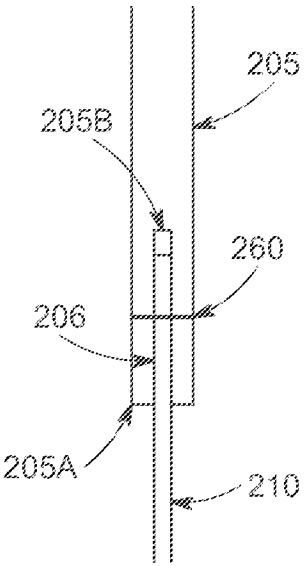
FIGS. 11A and 11B illustrate certain improved methods of assembly and manufacture of the second embodiment of the outer protective barrier.
Figure 11B:
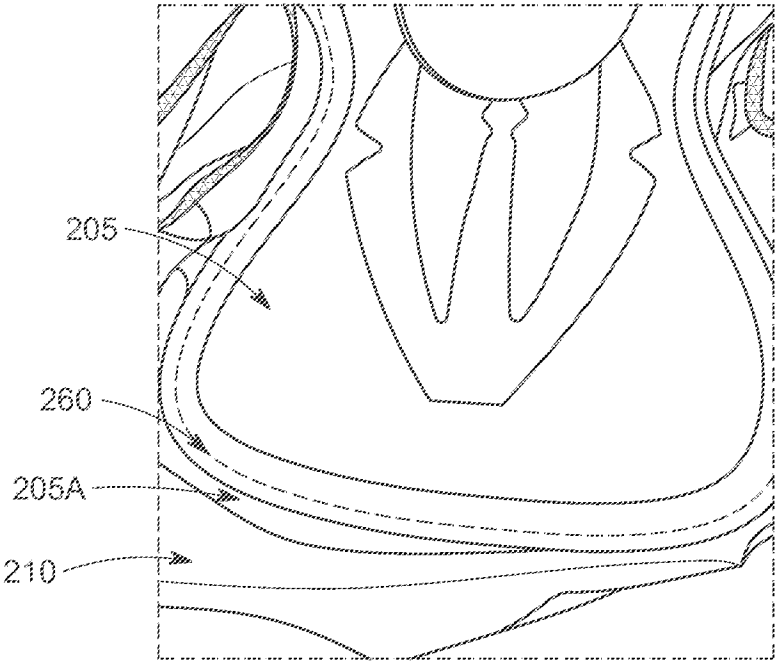

Referring to FIGS. 11A and 11B an improved interface between the moisture impervious barrier 210 and chest protective portion 205 is illustrated. As shown in FIGS. 11A and 11B, the chest protective portion 205 can include a channel 206 molded or manufactured in an end 205A of the chest protective portion 205. The channel 206 extends around and into the outer periphery of the chest protective portion 205. The cutout edge of the moisture impervious barrier 210 is inserted into the channel 206 disposed around the edge 205A of the chest protective potion 205 and is sewn by stitching 260 so as to affix the moisture impervious portion within the channel 206 of the chest protective portion 205. As shown in FIGS. 11A and 11B the chest protective portion 205 overlays both an interior side and an exterior side of the moisture impervious barrier 210. As such, food, crumbs, liquids, etc. are not caught by a seam as discussed with reference to FIG. 10.

Figure 12A:
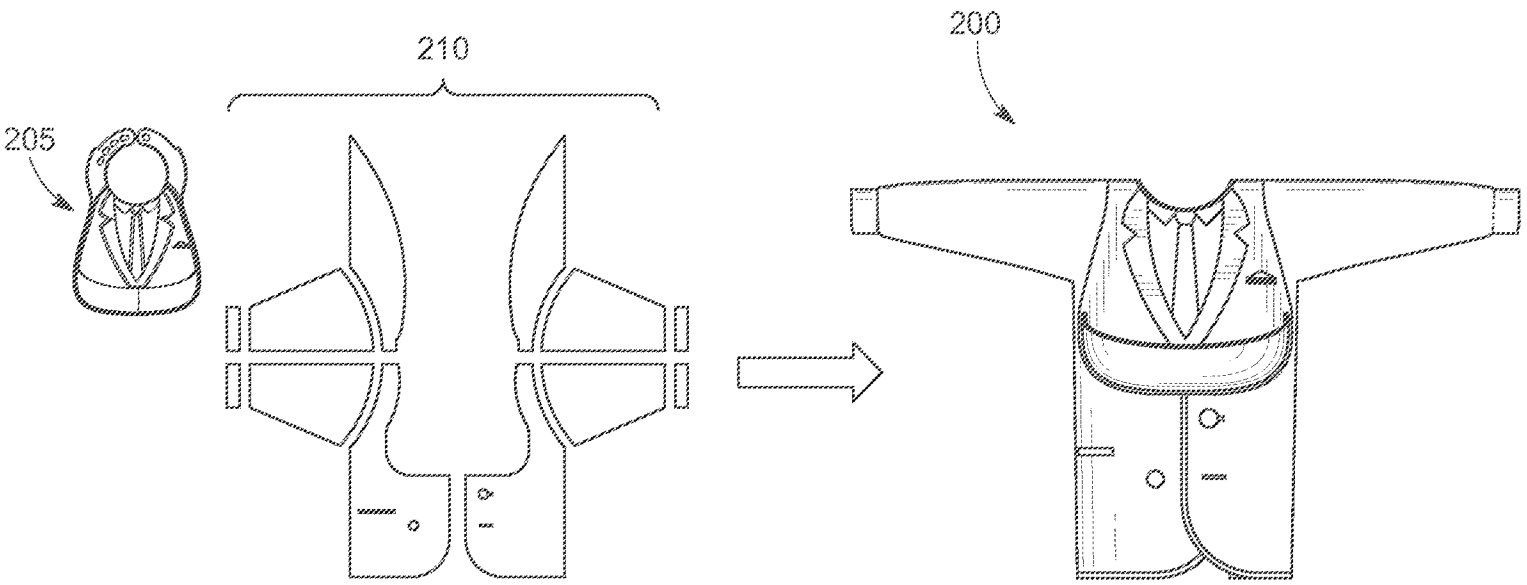
FIGS. 12A and 12B illustrate methods of assembly and manufacture of the second embodiment of the outer protective barrier including assembly.
Figure 12B:
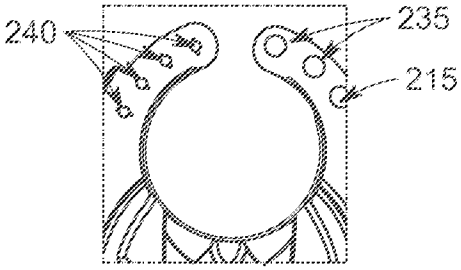

FIGS. 12A and 12B illustrate an example of the manufacture and construction of the tuxedo embodiment 200 of the present invention. A method of manufacturing a protective outer garment is shown in FIGS. 12A and 12B. The method can include molding a substantially resilient front protective portion for covering the chest of a wearer that includes a holder shaped to catch and hold solids and liquids spilled upon the substantially resilient front protective portion while the wearer is eating or performing another activity. The method can further include affixing a moisture impervious barrier for covering at least the shoulders and waistline of the wearer to the substantially resilient front protective portion. A hemline of the moisture impervious barrier corresponds in shape to an outer periphery of the substantially resilient front protective portion. The hemline of the moisture impervious barrier can be sewn to the outer periphery of the substantially resilient front protective portion. The method can further include molding a peripheral channel at least partially around a periphery of the substantially resilient front protective portion, the hemline of the moisture impervious barrier being at least partially disposed within the peripheral channel of the substantially resilient front protective portion (e.g. see FIGS. 11A and 11B). The act of molding a substantially resilient front protective portion for covering the chest of the wearer can further include molding the shape or appearance of a tie and lapel into a front side of the substantially resilient front protective portion. The act of molding a substantially resilient front protective portion for covering the chest of the wearer further includes molding the shape or appearance of simulated jewelry, a tie, lapels, or a collar into a front of the substantially resilient front protective portion.

FIGS. 12A and 12B also shows the rear of the protective outer garment 200 having optional perpendicular slots 240. In some embodiments, the slots 240 may be omitted using only protrusions with a plurality of holes 240. Here, the collar 215 includes one or more protrusions 235 corresponding with a series of interlocking holes and slots 240 for connecting the rear ends of the collar 215 together when worn. The protrusion 235 can be in the form of a button on a post and is sized to fit into the holes and slots 240 so as to secure the collar 115 around the neckline of the wearer of the protective outer garment 200. Buttons, ties, VELCRO, or other connection means can be used. The slots 240 can extend parallel to a direction of extension of the collar 215 or the slots can extend perpendicular to a direction of extension of the collar 215. According to this embodiment of the collar 215, the slots 240 extend perpendicular to a direction of extension of the collar 215. Because the slots 240 extend perpendicular to the direction of extension of the collar 215 as opposed to parallel thereto, the collar does not need to be constricted around the child's neck to connect and disconnect the buttons 235 to the holes/slots 240. Thus, the protective outer garment 200 can be worn without the discomfort of constricting the collar 215 around a wearer's neck when the attachment features 235 and 240 are connected and disconnected. Similar manufacturing, use, and designs can be applied to the first embodiment 100 of the invention as well as other designs and embodiments what would be applied by one of ordinary skill in the art in view of the teachings and example embodiment disclosed herein to illustrate various improvements.

The present invention is further directed to methods of manufacturing and use of an integrated protective outer garment. Examples of such protective outer garments, use, and manufacture steps are previously discussed and can include molding a substantially resilient front protective portion for covering the chest of the wearer that includes a holder shaped to hold solids and liquids spilled upon the substantially resilient front protective portion. The methods can further include affixing a moisture impervious barrier for covering the shoulders, neckline, chest and waistline of a wearer to the substantially resilient front protective portion. A hem of the moisture impervious barrier can correspond in shape to the outer periphery of the substantially resilient front protective portion. The outer protective barrier may be manufactured such that the hem of the moisture impervious barrier is water-tight sewn to the outer periphery of the substantially resilient front protective portion.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A protective outer garment comprising: a moisture impervious barrier for covering at least shoulders and a waistline of a wearer; and a substantially resilient front protective portion for covering at least a portion of a chest of the wearer, the substantially resilient front protective portion including a holder shaped to catch and hold solids and liquids spilled upon the substantially resilient front protective portion, wherein the moisture impervious barrier includes a hemline conforming to at least sides and a bottom outer periphery of the substantially resilient front protective portion, the sides and bottom outer periphery extending around and below the holder, the hemline of the moisture impervious barrier being sewn to at least the sides and the bottom outer periphery of the substantially resilient front protective portion; and a collar, the collar including one or more fastening features disposed at opposing ends of the collar for temporarily securing the collar around a neck of the wearer.

2. The protective outer garment according to claim 1, wherein the moisture impervious barrier is configured to cover at least a portion of arms of the wearer and at least upper legs of the wearer.

3. The protective outer garment according to claim 1, the substantially resilient front protective portion including a peripheral channel conforming to a shape of the hemline of the moisture impervious barrier.

4. The protective outer garment according to claim 3, the hemline of the moisture impervious barrier being received within the peripheral channel of the substantially resilient front protective portion, the peripheral channel being sewn along with the hemline of the moisture impervious barrier disposed therein so as to securely fasten the hemline within the peripheral channel of the substantially resilient front protective portion.

5. The protective outer garment according to claim 1, the moisture impervious barrier including a waistline, wherein the waistline of the moisture impervious barrier:

is formed integral with an upper portion and/or a lower portion of the moisture impervious barrier; or is seamless relative to the upper and/or lower portion of the moisture impervious barrier.

6. The protective outer garment according to claim 5, the lower portion comprising a dress extending below the waistline.

7. The protective outer garment according to claim 6, the dress including a front slit for accommodating a restraining strap of a chair.

8. The protective outer garment according to claim 1, the moisture impervious barrier configured to have an appearance of a tuxedo jacket.

9. The protective outer garment according to claim 1, the moisture impervious barrier and/or the substantially resilient front protective portion being devoid of molded protrusions.

10. The protective outer garment according to claim 1, the moisture impervious barrier is configured to extend over shoulders and around a back of the wearer.

11. The protective outer garment according to claim 1, wherein the substantially resilient front protective portion is formed of silicone, rubber, or plastic.

12. The protective outer garment according to claim 1, the substantially resilient front protective portion having protrusions molded thereon.

13. The protective outer garment according to claim 1, the substantially resilient front protective portion being molded to simulate an appearance of lapels and a tie.

14. A method of manufacturing a protective outer garment, comprising: molding a substantially resilient front protective portion for covering a chest of a wearer that includes a holder shaped to catch and hold solids and liquids spilled upon the substantially resilient front protective portion; and affixing a moisture impervious barrier for covering at least shoulders and a waistline of the wearer to the substantially resilient front protective portion, wherein a hemline of the moisture impervious barrier corresponds in shape to an outer periphery of sides and a bottom of the substantially resilient front protective portion, and wherein the hemline of the moisture impervious barrier is sewn to the outer periphery of the substantially resilient front protective portion.

15. The method of manufacturing the protective outer garment according to claim 14, further comprising molding a peripheral channel at least partially around a periphery of the substantially resilient front protective portion, the hemline of the moisture impervious barrier being at least partially disposed within the peripheral channel of the substantially resilient front protective portion.

16. The method of manufacturing the protective outer garment according to claim 14, wherein the act of molding a substantially resilient front protective portion for covering a chest of the wearer further includes molding a shape or appearance of a tie and lapel into a front side of the substantially resilient front protective portion.

17. The method of manufacturing the protective outer garment according to claim 14, wherein the act of molding a substantially resilient front protective portion for covering the chest of the wearer further includes molding the shape or appearance of simulated jewelry into a front of the substantially resilient front protective portion.

18. The protective outer garment according to claim 14, the moisture impervious barrier and/or the substantially resilient front protective portion being devoid of design features.

19. A protective outer garment comprising:

a moisture impervious barrier for covering at least shoulders and a waistline of a wearer, the moisture impervious barrier having an appearance of a dress or a tuxedo jacket, the moisture impervious barrier including a hemline conforming to a shape of sides and a bottom of a substantially resilient front protective portion; and the substantially resilient front protective portion configured to cover at least a chest of the wearer, the substantially resilient front protective portion being molded from silicone and including:

a holder shaped to catch and hold solids and liquids spilled upon the substantially resilient front protective portion;

an adjustable collar, the adjustable collar including one or more fastening features disposed at opposing ends of the adjustable collar for temporarily securing the adjustable collar around a neck of the wearer;

a peripheral channel having the hemline of the moisture impervious barrier disposed therein;

stitching through walls of the peripheral channel and through the hemline of the moisture impervious barrier, the stitching securing the moisture impervious barrier to the substantially resilient front protective portion; and molded features simulating jewelry or tuxedo tie and lapels.

* * * * *